United States Patent [19]

Fischer

[11] 4,340,499

[45] Jul. 20, 1982

[54] METHOD FOR TREATING RADIOACTIVE SOLUTIONS

[75] Inventor: Gustav Fischer, Nuremberg, Fed. Rep. of Germany

[73] Assignee: Kraftwerk Union Aktiengesellschaft, Mülheim, Fed. Rep. of Germany

[21] Appl. No.: 125,678

[22] Filed: Feb. 28, 1980.

[30] Foreign Application Priority Data

Mar. 14, 1979 [DE] Fed. Rep. of Germany ..... 2910034

[51] Int. Cl.[3] ..... G21F 9/10; G21F 9/12; G21F 9/16

[52] U.S. Cl. ..... 252/628; 210/682; 210/759; 210/912

[58] Field of Search ..... 252/301.1 W; 210/912, 210/759, 682

[56] References Cited

U.S. PATENT DOCUMENTS

| | | | |
|---|---|---|---|
| 2,769,780 | 11/1956 | Clifford et al. | 252/301.1 R |
| 3,013,978 | 12/1961 | Rosinski | 252/301.1 W |
| 3,272,738 | 9/1966 | Pitzer et al. | 210/912 |
| 3,873,362 | 3/1975 | Mihram et al. | 252/301.1 W |
| 4,226,640 | 10/1980 | Bertholdt | 252/301.1 W |

FOREIGN PATENT DOCUMENTS

| | | | |
|---|---|---|---|
| 1517664 | 4/1971 | Fed. Rep. of Germany | 252/301.1 W |
| 1520681 | 4/1968 | France | 252/301.1 W |
| 51-085266 | 1/1975 | Japan | 210/912 |

OTHER PUBLICATIONS

Pavlik et al., "Treatment of High Detergent Content Radioactive Wastewater", *Chem. Abs.* 87:140673t (1977).

Verot et al., "Problems Posed by the Treatment of Effluents . . .", *Chem. Abs.* 71:15872a (1969).

*Primary Examiner*—Deborah L. Kyle

*Attorney, Agent, or Firm*—Herbert L. Lerner; Laurence A. Greenberg

[57] ABSTRACT

Concentrated liquid waste solutions containing radioactive substances and also complex formers is treated by maintaining pH 5 and adding $KMnO_4$ to oxidize complex formers, and solidifying and embedding the resultant solution in a binder. Dilute solutions are also maintained at a pH of 5 and excess $KMnO_4$ added. The excess $MnO_4^-$ is reduced to $MnO_2$ by addition $MnSO_4$. $MnO_2$ separates and adsorbs radionuclides Mn-54, Sb-124, Sb-125 and 65 Zn contained in the solution.

3 Claims, No Drawings

METHOD FOR TREATING RADIOACTIVE SOLUTIONS

BACKGROUND OF THE INVENTION

1. Field of the Invention

The present invention relates to a method for the treatment of concentrated radioactive solutions which contain organic compounds as sequestering agents or complex formers.

2. Description of the Prior Art

Such liquid wastes contain radioactive substances and complex formers as for example, citric, oxalic, formic acid or ethylenediaminetetraacetic acid (EDTA) and must never be discharged. These wastes must rather be counted among the radioactive wastes and must be disposed of safely as such, possibly after being concentrated, through appropriate storage, for instance, in salt mines. For this purpose it is necessary to solidify them first. One possibility of this kind is to process them with cement and additives into concrete blocks.

Radioactive solutions with organic complex formers, however, are difficult to bind in concrete and in addition, the radionuclide complexes present therein are soluble and can therefore be leached out readily. Heretofore, such liquid wastes with organic complex formers always had to be evaporated, since precipitation reactions for removing the radioactive substances are prevented or at least interfered with by these complex compounds.

Since such a method, however, is very complicated and requires considerable energy, the problem arose to find a substantially simpler method for compacting the radioactive substances contained in these liquid wastes.

SUMMARY OF THE INVENTION

With the foregoing and other objects in view, there is provided in accordance with the invention a method for treating concentrated liquid waste solutions containing radioactive substances and also organic compounds as complex formers which comprises adding potassium permanganate to the solution while maintaining the pH of the solution at about 5 to oxidize the complex formers and continuing the oxidation with potassium permanganate and maintaining the pH of the solution at about 5 until a typical $KMnO_4$ color remains in the solution for at least 10 hours, and subsequently solidifying and embedding the treated solution substantially free of complex formers in a binder.

In accordance with the invention, there is provided a method of treating dilute liquid waste solutions containing radioactive substances and also organic compounds as complex formers which comprises maintaining the pH of a dilute solution containing radionuclides and complex formers at about 5 and adding potassium permanganate to the solution in excess amount to oxidize the complex formers, and subsequentially adding $MnSO_4$ to the solution to reduce the excess $MnO_4^-$ in the solution to $MnO_2$ which latter separates as a solid from the solution and adsorbs radionuclides Mn-54, Sb-125, Sb 125 and 65-Zn contained in the initial solution subjected to treatment.

A further embodiment of the invention wherein the initial solution contains 58,60 Co radionuclides, including separating the solution from said $MnO_2$, includes raising the pH of the separated solution to about 10.5, adding a complex $Co^{+3}$ salt to the solution, adding a reducing agent to the solution to reduce $Co^{+3}$ compounds to $Co^{+2}$ compounds, adding a decomplexing agent to free $Co^{+2}$ from the complex compound, and then adding a precipitating agent to the solution to precipitate $Co^{+2}$ as a compound insoluble in the solution.

Other features which are considerable as characteristic for the invention are set forth in the appended claims.

Although the invention is illustrated and described herein as embodied in a method for treating radioactive solutions, it is nevertheless not intended to be limited to the details shown, since various modifications may be made therein without departing from the spirit of the invention and within the scope and range of equivalents of the claims.

In accordance with the invention the complex formers are first destroyed. A concentrated solution of liquid wastes is adjusted to a pH of 5 through the addition of $H_2SO_4$ or NaOH. Potassium permanganate $KMnO_4$ is then added in powder form or as cold-saturated (approximately 6%) solution as an oxidant, in the process of which $CO_2$ escapes. The dosaging of $KMnO_4$ is continued, holding the pH-value constant by means of $H_2SO_4$ until the typical $KMnO_4$ color of the supernatant solution remains for at least 10 hours. This solution is then solidified with cement. The reaction heat produced in this process heats the solution so that the reaction rate is increased thereby. At the conclusion of the chemical reaction, a salt and solids content of 10 to 15% is present in the solution $MnO_2$, $K_2SO_4$ and other solids and salts make-up the 10–15%. Since complex formers or sequestering agents are no longer contained in this solution a good procedure is to solidify the latter directly with cement. The radionuclides are thereby present in the cement largely as insoluble compounds and as a result they cannot be dissolved from the concrete block form. Instead of cementing, embedding in bitumen after drying may be employed. The solidifying and embedding of concentrates with a binder such as cement, bitumen and plastics is known in the art.

In case the starting solution is not present in concentrated but in diluted form, in order to destroy the complex formers the solution is likewise adjusted to a pH-value of 5 by the addition of $H_2SO_4$ or NaOH, and subsequently an excess of $KMnO_4$ is added as an oxidant. Then the $MnO_4^-$ excess is reduced to $MnO_2$ by adding $MnSO_4$ and all the $MnO_2$ is allowed to settle together with the adsorbed radionuclides such as Mn-54, Sb-124, Sb-125 and 65-Zn, if these substances were contained in the starting solution. The settled substances are then removed from the reaction vessel and solidified with cement or bitumen and thereby made suitable for storage. If no other radionuclides are present in the solution, further treatment or processing of the solution can follow in the usual manner. The decontamination factor obtained for the above-mentioned nuclides is $\geqq 100$.

In the event cesium radionuclides are present in the initial dilute solution, for instance, as Cs 134 and Cs 137, the pH-value is adjusted, for example, with sodium hydroxide to 9 after the complex formers have been destroyed as described above, and the $MnO_2$ has been separated. Thereupon, $K_4Fe(CN)_6$, dissolved in water, is added. Precipitation of $Ni_2Fe(CN)_6$ in the solution is brought about with added $NiSO_4$, which precipitate settles out well and practically completely precipitates the cesium at the same time. The decontamination factor obtainable in this manner for Cs-radionuclides is between 700 and 1,000. This means that for all practical purposed cesium is no longer contained in the supernatant solution. The settled sludge is separated from the solution and is solidified with cement or bitumen.

Due to the $KMnO_4$ oxidation, $^{58,60}Co$ is present as $Co^{+3}$ in complex form. For handling the $^{58,60}Co$ traces, i.e., for the isotope exchange, $[Co^{+3}(NH_3)_6]Cl_3$ or a similar $Co^{+3}$ salt is added to the solution as a carrier. In an alkaline solution (pH-value adjusted by adding, for example, $NH_3$), $Co^{+3}$ is reduced to $Co^{+2}$ by a strong reduction agent such as $Na_2S_2O_4$, $FeSO_4$, $SnCl_2$ or similar reducing agent. The complex component is allowed to set by adding $Ca^{+2}$, $Sr^{+2}$ or similar substances as decomplexing agents, so that $Co^{+2}$ ($^{58,60}Co$) can be separated completely in a known manner, for instance, with $NH_4HS$ to produce CoS, or a similar separating substance from the solution (decontamination factor $\geqq 2{,}000$).

In order to prevent loss of the reducing agent in part by autooxidation and thus insufficient for the complete reduction of $Co^{+3}$, requiring considerably more reduction agent to be used, this process is carried out in a closed vessel with the exclusion of air, i.e. in an atmosphere of a protective gas such as $N_2$, argon or a similar gas.

Depending on the radionuclides contained in the starting solution, it is possible to carry out the precipitation reactions described sequentially, after the complex formers are destroyed.

There are claimed:

1. Method of treating aqueous waste solutions containing $Co^{58}$ and $Co^{60}$, other radionuclides selected from the group consisting of $Mn^{54}$, $Sb^{124}$, $Sb^{125}$ and $Zn^{65}$ and mixtures thereof and organic complexing agents, which comprises maintaining the pH of the solution at about 5 and adding alkali-metal permanganate to the solution in excess amount to oxidize the complexing agents and subsequently adding $MnSO_4$ to the solution to reduce the excess $MnO_4^-$ in the solution to $MnO_2$ which latter separates as a solid from the solution and adsorbs said other radionuclides contained in the aqueous solution subjected to treatment, separating the solids from the solution raising the pH of the separated solution to about 10.5, adding a complex $[Co^{+3}(NH_3)_6]\ Cl_3$ salt as a carrier for $Co^{58}$ and $Co^{60}$ to the solution, adding a reducing agent to the solution to reduce $Co^{+3}$ to $Co^{+2}$, adding a decomplexing agent to free $Co^{+2}$ from the complex, and then adding a precipitating agent to the solution to precipitate $Co^{+2}$ as a compound insoluble in the solution, and subsequently encapsulating the said solids and said insoluble compounds in a binder.

2. Method according to claim 1, wherein the reducing agent is a compound selected from the group consisting of $Na_2S_2O_4$, $FeSO_4$ and $SnCl_2$, wherein the decomplexing agent is a compound containing an atom selected from the group consisting of $Ca^{+2}$ and $Sr^{+2}$, and wherein the precipitating agent is $NH_4HS$.

3. Method according to claim 1 or claim 2, wherein the oxidizing of the complexing agents is continued for at least 10 hours.

* * * * *